US005147013A

United States Patent [19]

Olson et al.

[11] Patent Number: 5,147,013

[45] Date of Patent: Sep. 15, 1992

[54] CONFINED SPACE ENTRY APPARATUS

[75] Inventors: Wayne L. Olson, Central Point, Oreg.; Gary E. Choate, Lakewood, Colo.

[73] Assignee: Rose Manufacturing Company, Englewood, Colo.

[21] Appl. No.: 605,565

[22] Filed: Oct. 29, 1990

[51] Int. Cl.[5] ..... A62B 1/08; B66D 5/02

[52] U.S. Cl. ..... 182/231; 182/236; 182/142; 254/267; 254/286

[58] Field of Search ..... 182/5, 128, 142, 231, 182/236; 254/267, 284, 286; 414/10, 11, 626

[56] References Cited

U.S. PATENT DOCUMENTS

| | | | |
|---|---|---|---|
| 193,259 | 7/1877 | Lewis et al. | 254/284 X |
| 1,123,776 | 1/1915 | Meyer | 182/5 X |
| 4,202,427 | 5/1980 | Sada et al. | 182/142 X |
| 4,660,679 | 4/1987 | Ostrobrod | 182/5 X |
| 4,781,269 | 11/1988 | Clay | 182/5 |
| 4,846,313 | 7/1989 | Sharp | 254/267 X |

FOREIGN PATENT DOCUMENTS

| | | | |
|---|---|---|---|
| 2421850 | 11/1975 | Fed. Rep. of Germany | 182/5 |
| 2545363 | 11/1984 | France | 182/231 |

*Primary Examiner*—Michael S. Huppert
*Assistant Examiner*—Janice Krizek
*Attorney, Agent, or Firm*—Klaas, Law, O'Meara & Malkin

[57] ABSTRACT

Apparatus for moving personnel or materials through an opening in a sidewall of a vessel and down into the vessel wherein a lower support and an upper support are mounted on the portion of the sidewall defining the opening and have a tripod supported thereon and located within the vessel. A hoist and a fall arresting device are mounted on the upper support and the cables thereof are passed over pulleys mounted on the tripod so that personnel or materials may be attached to the snaphook on the end of the cable and moved through the opening and lowered into the vessel.

19 Claims, 2 Drawing Sheets

CONFINED SPACE ENTRY APPARATUS

FIELD OF THE INVENTION

The invention relates generally to the movement of personnel or materials into a vessel and more particularly to the movement of personnel or materials through an opening in the sidewall of the vessel and lowering or raising of the personnel or materials in the vessel.

BACKGROUND OF THE INVENTION

There are many types of mounting means for supporting hoists and fall arresting apparatus for lowering personnel and materials into a vessel. In some instances it is necessary to move personnel or materials through an opening in the sidewall of a vessel such as a circular tank. This presents a problem relative to the support means mounting standard equipment, such as a hoist and a fall arresting device, so that the personnel or materials can be moved through the opening and lowered inside the vessel. Therefore, there exists a need for the mounting of load supporting means on the sidewall of the vessel surrounding the opening so that personnel or materials can be safely passed through the opening and lowered inside of the vessel.

BRIEF DESCRIPTION OF THE INVENTION

This invention provides apparatus for moving personnel or materials through an opening in a vessel enclosing a space and the lowering or raising of the personnel or materials in the vessel.

In a preferred embodiment of the invention, an opening is formed in the sidewall of a vessel. A lower support is mounted on the lower portion of the sidewall defining the opening and an upper support is mounted on the upper portion of the sidewall defining the opening. Load supporting means are mounted on the lower and upper supports and are located within the vessel. A hoist is mounted on the upper support. Line means, such as a cable, are provided for the hoist and have a first end attached to the hoist so that the line means can be wound into or unwound out of the hoist and a second end of the line means has a load supporting device attached thereto. A pulley is mounted on the load supporting means and the line means are passed over the pulley. Drive means are provided for moving the line means into or out of the pulley. A fall arresting device is also mounted on the upper support and the line means thereof are passed over another pulley mounted on the load supporting means. In the preferred embodiment of the invention, the load supporting means comprises a tripod having the bottom portions of two legs supported on the lower support and the bottom portion of one leg supported on the upper support. Connecting means are provided for connecting together the top portions of the three legs. Roller guide means are mounted on the upper support and are located inside the vessel to guide the line means from the hoist and the fall arresting device to their respective pulley. Roller means are mounted on the lower support and are located outside of the vessel to guide the line means of the hoist and fall arresting device when they are outside of the vessel. A platform is provided on the lower support and is located inside the vessel.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
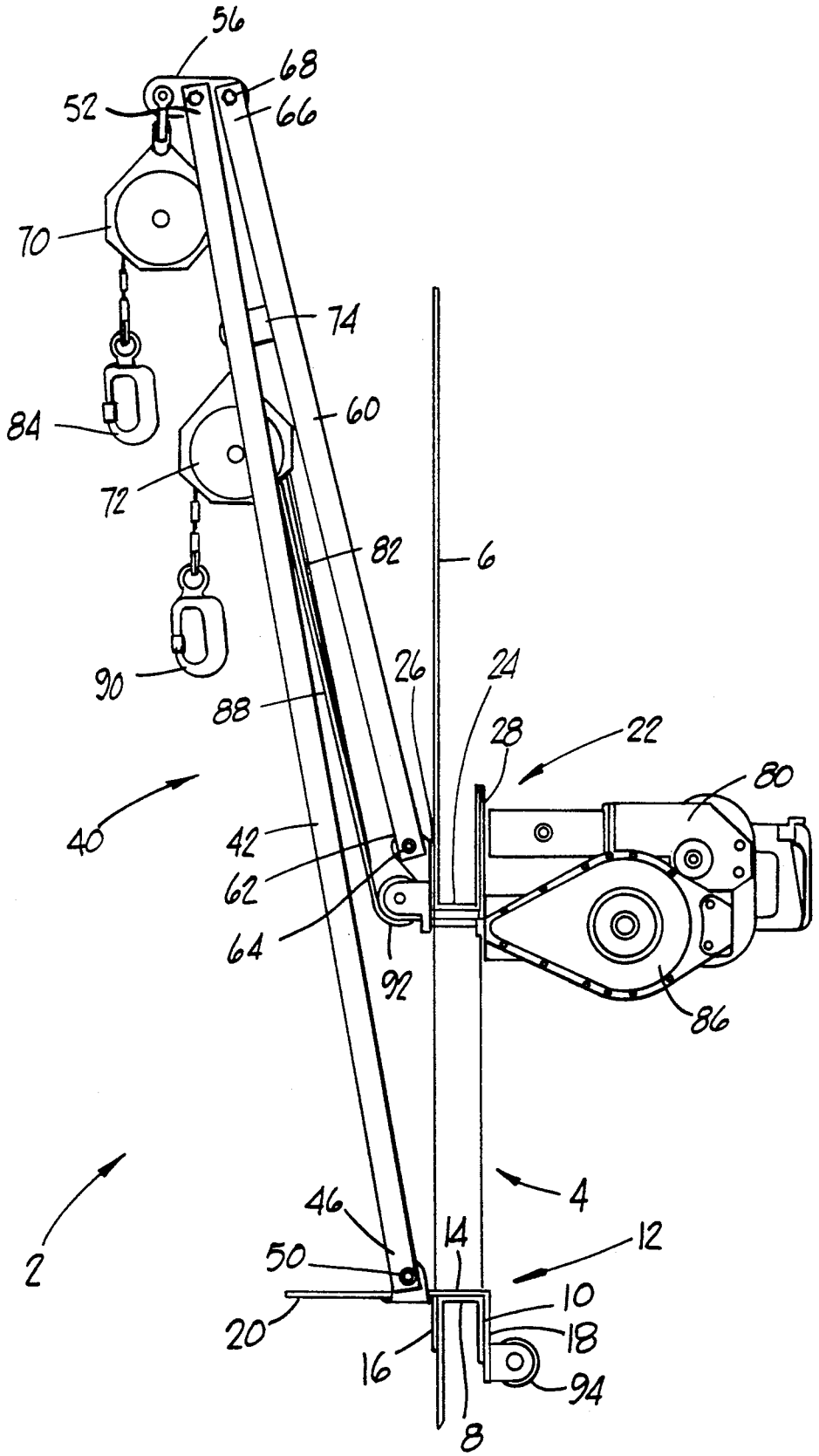
FIG. 1 is a side elevational view of the apparatus of this invention.
Figure 2:
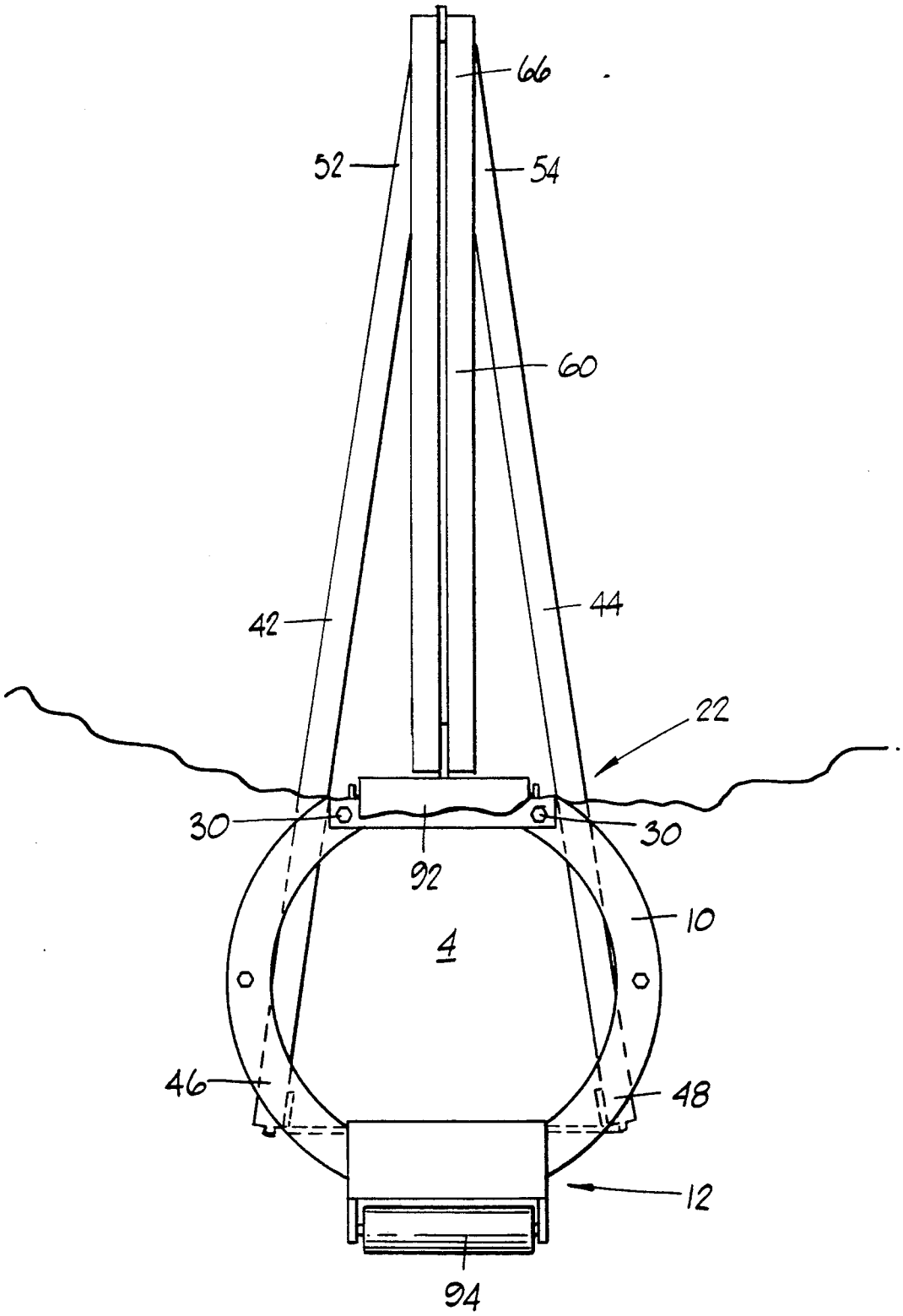
FIG. 2 is an elevational view from the right side of FIG. 1.

In FIGS. 1 and 2, there is illustrated apparatus 2 for moving personnel or materials through an opening 4 in a sidewall 6 of a vessel, such as a circular tank. An annular projection 8 extends outwardly from the sidewall 6 and has an integral flange portion 10. A lower support 12 comprising a base portion 14 and two depending leg portions 16 and 18 is mounted on the lower portion of the annular projection 8. A platform 20 integral with the base portion 14 extends inwardly into the vessel. An upper support 22 comprising a base portion 24 and two upwardly extending leg portions 2 and 28 is mounted on the upper portion of the annular projection 8. The upper support 22 is connected to the flange portion 10 by bolts and nuts 30.

Load supporting means 40 are provided and comprise a tripod having two long legs 42 and 44, each of which are about 87 inches in length, are formed from angle iron and having the bottom portions 46 and 48 thereof fixedly secured at spaced apart locations on the lower support 12 by suitable means such as removable pins 50. The top portions 52 and 54 of the two legs 42 and 44 are connected to a connecting bracket 56 by suitable means such as by welding. A short leg 60, which is about 56 inches in length, is formed from angle iron and has a bottom portion 62 thereof fixedly secured to the upper support 22 by suitable means such as a removable pin 64 and the top portion 66 thereof is connected to the connecting bracket 56 by suitable means such as a nut and a bolt 68. A first pulley 70 is pivotally supported on the connecting bracket 56 and a second pulley 7 is pivotally connected to a bracket 74 secured on the short leg 60.

A personnel or materials hoist 80 is mounted on the upper support 22 and has line means 82 extending out of the personnel or materials hoist 80 and passing around the first pulley 70. A swivel snaphook 84 is secured on the end of the line means 82. A fall arresting device 86 is mounted on the upper support 22 and has line means 88 extending out of the fall arresting device 86 and passing around the second pulley 72. A swivel snaphook 90 is secured on the end of the line means 88.

A first guide roller 92 is mounted on the upper support 22 and is located inside the vessel sidewall 6. The line means 82 and 88 pass over the guide roller 92. Another guide roller 94 is mounted on the lower support 12 and is located outside of the vessel sidewall 6. The second guide roller 94 is for emergency use to guide an injured worker being moved through the opening 4 and lowered on the outside of the vessel.

Under normal conditions, there will be a supporting platform (not shown) on which personnel can stand to operate the personnel or materials hoist 80. When it is desired for a worker to go inside the vessel and be lowered therein, the worker will put on conventional harness equipment and have its dorsal and frontal D-rings secured to the snaphooks 84 and 90. The slack is taken out of the line means 82 and 88 and then the worker's weight will be supported by the line means 82 so that he can be moved inwardly through the opening 4 and then lowered inside the vessel.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for moving a load, such as personnel or materials, through an opening in a sidewall of a vessel and lowering or raising of the load inside of the vessel comprising:

a vessel having a sidewall for defining the inside and outside of said vessel and having an opening in said sidewall;

a lower support mounted on the lower portion of the sidewall defining said opening;

an upper support mounted on an upper portion of said sidewall defining said opening;

load supporting means mounted on said lower and upper supports and located within said vessel for supporting said load;

at least one hoist mounted on said upper support;

line means attached at a first end to said hoist for being wound into or unwound out of said hoist;

a pulley mounted on said load supporting means and located within said vessel;

a load supporting device; and said line means passing over said pulley and having a second end connected to said load supporting device for lowering or raising said load within said vessel.

2. The apparatus as in claim 1 wherein said load supporting means comprises:

a tripod.

3. Apparatus for moving a load, such as personnel or materials, through an opening in a sidewall of a vessel and lowering or raising of the load inside of the vessel comprising:

a lower support mounted on the lower portion of the sidewall defining said opening;

an upper support mounted on an upper portion of said sidewall defining said opening;

load supporting means mounted on said lower and upper supports and located within said vessel for supporting said load;

at least one hoist mounted on said upper support;

line means attached at a first end to said hoist for being wound into or unwound out of said hoist;

a pulley mounted on said load supporting means;

a load supporting device;

said line means passing over said pulley and having a second end connected to said load supporting device for lowering or raising said load within said vessel;

said load supporting means comprising two rods mounted on said lower support;

said rods being spaced apart at the bottom portions thereof and joined together at the top portions thereof; and a center rod having a bottom portion mounted on said upper support and a top portion connected with said top portions of said two rods.

4. The apparatus as in claim 3 and further comprising:

connecting means for connecting together said top portions of said rods and said center rod.

5. The apparatus as in claim 4 wherein:

said pulley is mounted on said connecting means.

6. The apparatus as in claim 1 and further comprising:

a guide roller mounted on said upper support and located inside said vessel for guiding the movement of said line means between said hoist and said pulley.

7. The apparatus as in claim 6 and further comprising:

a roller mounted on said lower support and located

8. The apparatus as in claim 7 and further comprising:

a platform on said lower support extending into said vessel.

9. Apparatus for moving a load, such as personnel or materials, through an opening in a sidewall of a vessel and lowering or raising of the load inside of the vessel comprising:

a lower support mounted on the lower portion of the sidewall defining said opening;

an upper support mounted on an upper portion of said sidewall defining said opening;

load supporting means mounted on said lower and upper supports and located within said vessel for supporting said load;

at least one hoist mounted on said upper support;

line means attached at a first end to said hoist for being wound into or unwound out of said hoist;

a pulley mounted on said load supporting means;

a load supporting device;

said line means passing over said pulley and having a second end connected to said load supporting device for lowering or raising said load within said vessel;

at least one fall arresting device mounted on said upper support;

line means attached at a first end to said fall arresting device for being wound into or unwound out of said fall arresting device;

another pulley mounted on said load supporting means; and said line means of said fall arresting device passing over said another pulley.

10. The apparatus as in claim 9 wherein said load supporting means comprises:

a tripod.

11. The apparatus as in claim 10 wherein said tripod comprises:

two rods mounted on said lower support;

said rods being spaced apart at the bottom portions thereof and joined together at the top portions thereof; and a center rod having a bottom portion mounted on said upper support and a top portion connected with said top portions of said two rods.

12. The apparatus as in claim 11 and further comprising:

connecting means for connecting together said top portions of said rods and said center rod.

13. The apparatus as in claim 9 and further comprising:

a guide roller mounted on said upper support and located inside said vessel for guiding the movement of said line means between said hoist and said pulley.

14. The apparatus as in claim 9 and further comprising:

a roller mounted on said lower support and located outside of said vessel.

15. The apparatus as in claim 9 and further comprising:

a platform on said lower support extending into said vessel.

16. The apparatus as in claim 14 and further comprising:

a guide roller mounted on said upper support and located inside said vessel for guiding the movement of said line means between said hoist and said pulley.

17. The apparatus as in claim 16 wherein said load means comprises:

a tripod.

18. The apparatus as in claim 17 wherein said tripod comprises:

two rods mounted on said lower support;

said rods being spaced apart at the bottom portions thereof and joined together at the top portions thereof; and a center rod having a bottom portion mounted on said upper support and a top portion connected with said top portions of said two rods.

19. The apparatus as in claim 18 and further comprising:

connecting means for connecting together said top portions of said rods and said center rod.

* * * * *

UNITED STATES PATENT AND TRADEMARK OFFICE

CERTIFICATE OF CORRECTION

PATENT NO. : 5,147,013

DATED : September 15, 1992

INVENTOR(S) : WAYNE L. OLSON and GARY E. CHOATE

It is certified that error appears in the above-identified patent and that said Letters Patent is hereby corrected as shown below:

Column 2, line 23, "portions 2" should read --portions 26--; and line 42, "second pulley 7: should read --second pulley 72--.

In the Claims:

Claim 7, Column 4, line 11, following the word "located", the words --outside of said vessel.-- were omitted and should be added.

Signed and Sealed this

Fourteenth Day of September, 1993

Bruce Lehman

*Attest:*

*Attesting Officer*

BRUCE LEHMAN

*Commissioner of Patents and Trademarks*